US005139362A

United States Patent [19]

Richter et al.

[11] Patent Number: 5,139,362

[45] Date of Patent: Aug. 18, 1992

[54] HEAT PASSAGE TUNNEL FOR SCREED BURNER

[75] Inventors: Kurt W. Richter, Thornhill; David P. Langley, Etobicoke, both of Canada

[73] Assignee: Ingersoll-Rand Company, Woodcliff Lake, N.J.

[21] Appl. No.: 596,701

[22] Filed: Oct. 10, 1990

[51] Int. Cl.[5] ..... F01C 23/14; F27B 17/00; F27B 3/00

[52] U.S. Cl. ..... 404/95; 432/186; 432/159

[58] Field of Search ..... 432/225-227, 432/159, 186; 126/343.5 A, 271.2, 400, 435; 404/95, 118, 114, 77; 237/2 B, 1 R

[56] References Cited

U.S. PATENT DOCUMENTS

| | | | |
|---|---|---|---|
| 492,594 | 2/1893 | Tomkinson | 432/186 |
| 1,209,321 | 12/1916 | Moyer | 432/186 |
| 1,567,143 | 12/1925 | Hay | 432/159 X |
| 1,614,085 | 1/1927 | Runyan | 432/159 |
| 2,136,993 | 11/1938 | Palmgren | 432/186 X |
| 2,225,166 | 12/1938 | Erby | 432/228 X |
| 3,407,596 | 10/1968 | Dasbach et al. | 432/159 X |
| 3,557,672 | 1/1971 | Shurtz | 404/95 |
| 4,379,653 | 4/1983 | Brown | 404/95 X |
| 4,389,980 | 6/1983 | Marcotte | 126/112 X |
| 4,407,605 | 10/1983 | Wirtgen | 404/77 |
| 4,482,314 | 11/1984 | Giese et al. | 432/11 |
| 4,752,155 | 6/1988 | Rennich | 404/95 |
| 4,765,772 | 8/1988 | Benedetti et al. | 404/77 |
| 4,830,608 | 5/1989 | Chambre | 432/11 |

*Primary Examiner*—Ramon S. Britts
*Assistant Examiner*—Nancy P. Connolly
*Attorney, Agent, or Firm*—Glenn B. Foster; John J. Selko

[57] ABSTRACT

A heating device for heating a substantially planar screed plate for a paving machine comprising a plate being spaced from the screed plate, and a space being defined therebetween. A heated gas inlet feeds into a tunnel connecting to the space. At least some of the heated gas is directed from the tunnel substantially parallel to the screed plate. The tunnel is formed from a plurality of tunnel branches with a orifice attached to the end of each tunnel orifice determining the direction where the heated gas will be directed.

12 Claims, 3 Drawing Sheets

HEAT PASSAGE TUNNEL FOR SCREED BURNER

BACKGROUND OF THE INVENTION

This invention relates generally to road paving machines and more particularly to heat tunnels to efficiently apply heat to a paving screed prior to operation of the paving machine.

During operation of paving machines, the heat of the pavement maintains screed plate temperatures roughly equivalent to the pavement temperature. However, when the machines are being used after a period of inactivity, the temperature of the screed plate is at a much lower temperature than the pavement.

Operation of the screed plate on pavement having a considerably higher temperature may result in inefficient operation of the screed and possible warping or other damage to the screed plate itself. More importantly, the paving material tends to adhere to the colder screed, possibly ruining the final paving material finish.

To remedy this situation, burner units have been installed to apply heated air to the interior of the screed, raising the screed plate temperature prior to screed operation. These burner units are typically removably mounted in an upper surface of the screed and are directed towards the screed plate.

Based on the relatively small heating area of the burner units compared to the relatively large screed plate area, only a small portion of the screed plate is often heated prior to screed operation. This increased heating of only a small portion of the screed plate can also result in damage to the screed plate.

The foregoing illustrates limitations known to exist in present screed plates. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a heating apparatus for heating a substantially planar surface comprising a plate being spaced from the surface, and a space being defined therebetween. A heated gas inlet feeds into a tunnel communicating with the space. At least some of the heated gas is directed from the tunnel substantially parallel to the surface.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
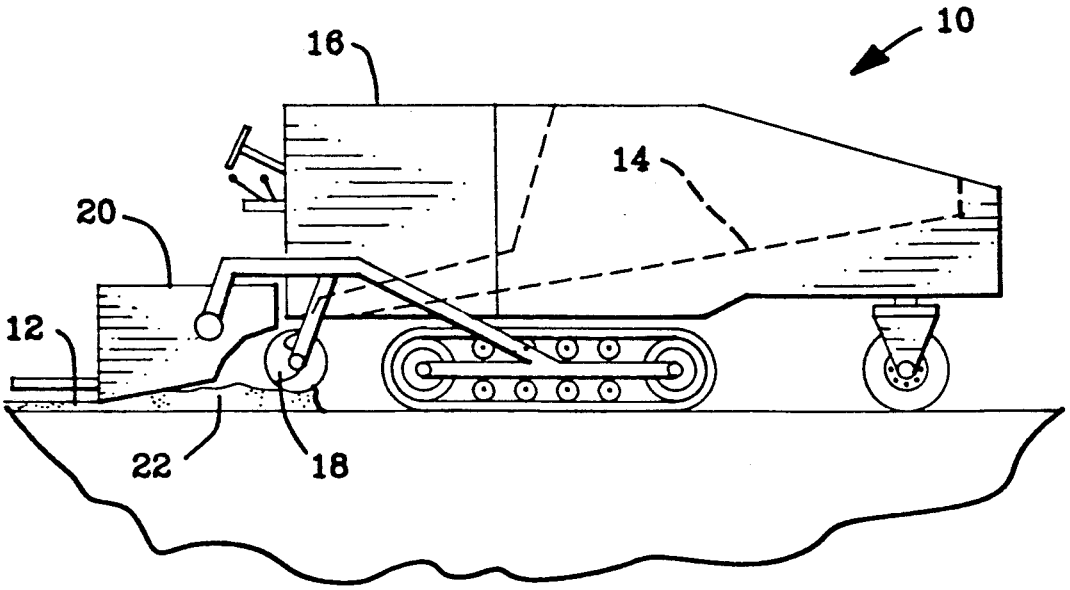
FIG. 1 is a side view illustrating an embodiment of a paving machine pulling a screed of the instant invention.

In this application, similar reference characters are used to illustrate identical elements in different embodiments.

As illustrated in FIG. 1, a paver 10 is used to pave roads or pavement 12. The paver 10 includes a hopper 14, a tractor 16, an auger 18 and a screed 20. The tractor 16 propels the paver 10.

The hopper 14 contains loose paving material 22 to be distributed along a length of pavement 12. The hopper feeds the loose paving material to the auger 18 which disperses it along a width of the pavement 12. Once the loose paving material 22 is laid by the auger 18, the screed 20 passes over it to compress it into the desired density, and to give it a final contour.

Figure 6:
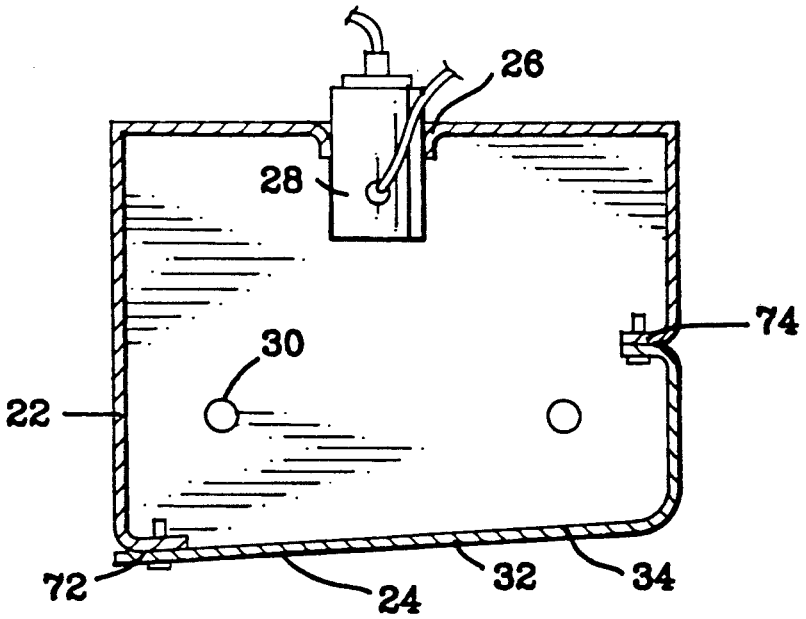
FIG. 6 ( PRIOR ART )
FIG. 6 is a sectional view of a prior art screed, illustrating a similar view as FIG. 5.

One prior art screed 20 illustrated in FIG. 6, includes one or more screed housings 22, a screed plate or planar surface 24, a burner recess or aperture 26 formed in the screed housing and a burner unit 28 which interfits within the burner aperture 26. A space 31 is defined within the screed housing 22 by the walls of the screed housing 22 and the screed plate 24.

A burner exhaust outlet 30 may be formed in the screed housing permitting a flow of heated gas through the space 31 and out the outlet 30 which spreads heat produced by the burner unit over a sizable portion of the screed plate 24. In this configuration, the entire space 31 must be heated by the burner unit 28 which leads to inefficient heating.

It is desirable for the temperature of the screed plate to be approximately the same as the loose paving material. This produces more efficient paving and reduces the damage to the screed plate which may result from exposure to considerably higher temperatures than the plate itself.

During the normal operation of the paver 10, the temperature of the screed plate 24 is roughly equivalent to the temperature of the loose paving material 22. However, when the paver 10 is being used for the first time after a period of nonuse, the initial screed plate temperature will be considerably lower than the pavement. The burner unit 28 raises the temperature of the screed plate 24 prior to use.

The burner unit 28, as utilized in the prior art screed illustrated in FIG. 6, does not heat the screed plate evenly. A first portion 32 of the screed plate 24, being close to the burner unit 28, will be at a much greater temperature than a second portion 34 of the screed plate more distant from the burner unit. This temperature differential can result in possible damage to, as well as inefficient heating of, the screed plate 24.

Figure 3:
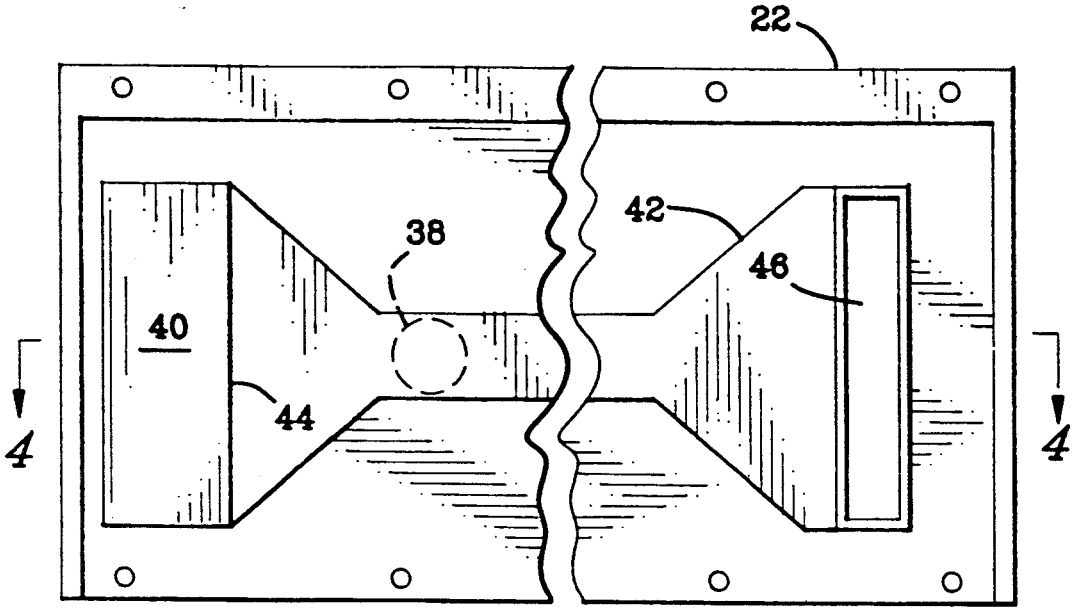
FIG. 3 is a view similar to FIG. 2 with the screed plate and an insulating plate removed.
Figure 4:
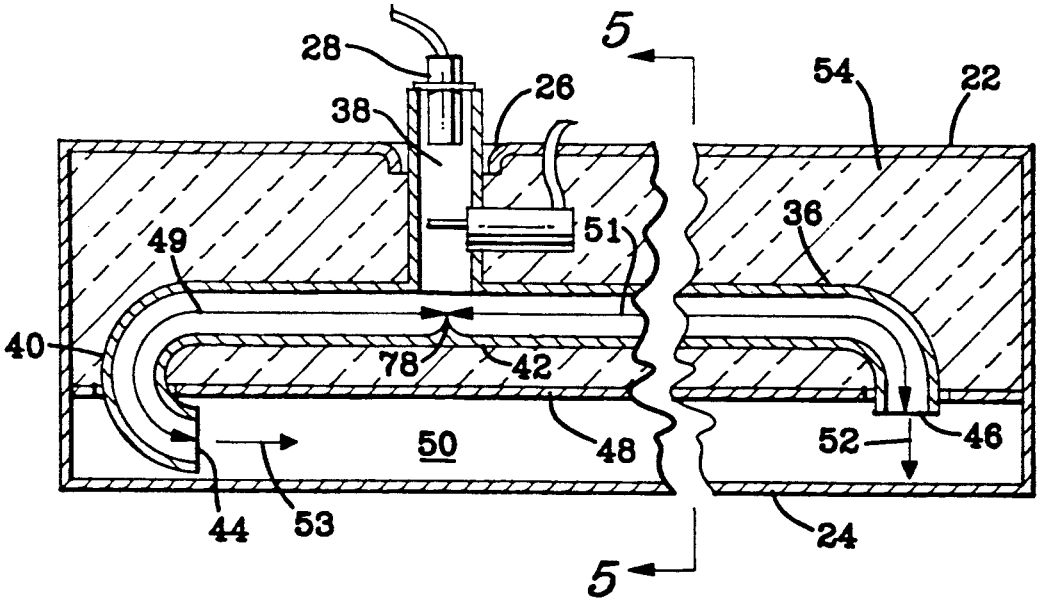
FIG. 4 is a sectional view as taken along sectional lines 4—4 of FIG. 3, similar to FIG. 3 except with the screed plate and the insulating plate in position.

To provide a more even heating of the screed plate 24 prior to screed 20 use, a tunnel 36 as illustrated in FIG. 4 may be installed. The tunnel 36 includes an inlet portion 38 (which interfits over the burner unit), one or more tunnel branches 40, 42 and an orifice 44, 46. Each tunnel branch 42, 44 preferably has a lesser cross sectional dimension adjacent the inlet portion than at the orifices 44, 46 as illustrated in FIG. 3.

The orifice 44 of tunnel branch 40 discharges heated gas in a direction parallel to the screed plate 24, while the orifice 46 of tunnel branch 42 extends in a direction perpendicular to the screed plate 24. Since the flow length 49 of tunnel branch 40 is shorter than the flow length 51 of tunnel branch 42 (tunnel branch 42 thereby providing greater resistance). More gas will thereby pass through tunnel branch 40 than tunnel branch 42, due to decreased resistance to flow.

Figure 2:
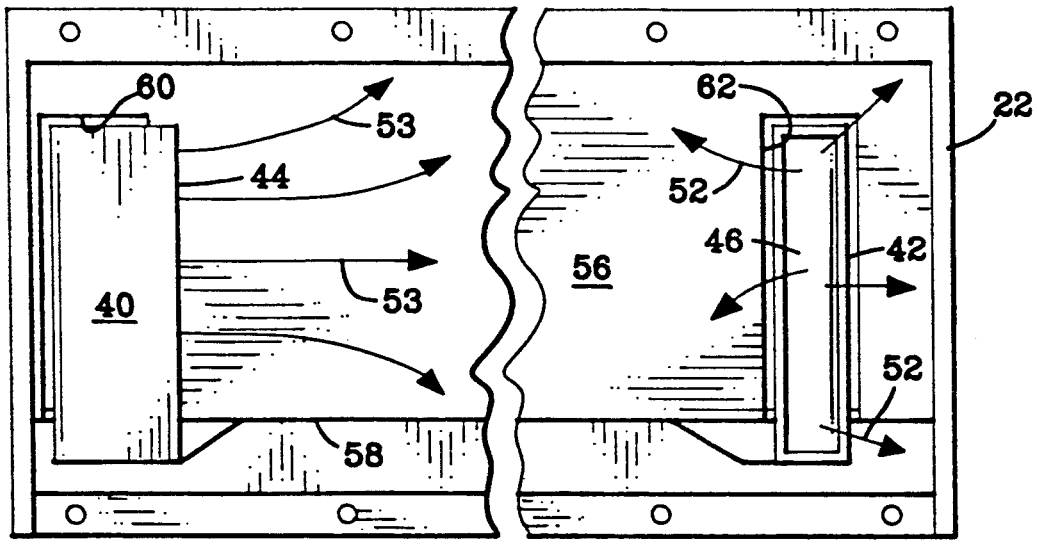
FIG. 2 is a bottom view of a screed of the instant invention with the screed plate removed.

Heated gas 53 passing from orifices 44 and 46 will distribute heat from the heated gas to the screed plate 24 much more efficiently than the prior art burner unit 28 as illustrated in FIG. 6 since a majority of the heated gas is travelling parallel to the surface in the instant configuration. Heated gas 52 passing from orifice 46 of tunnel branch 42 will travel radially from the axis of the orifice. This will cause the heated gas 53 passing from orifice 46 to expand outwardly as it exits the orifice 44 as illustrated in FIG. 2, further contributing to an even transfer of heat throughout the screed plate 24.

Figure 5:
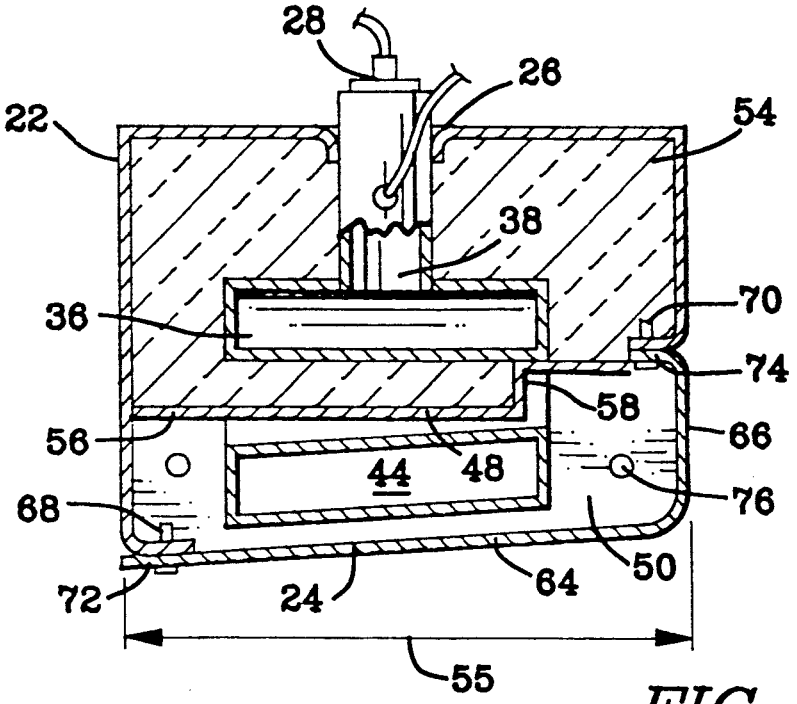
FIG. 5 is a sectional view, as taken along section lines 5—5 of FIG. 4.

An insulating plate or insulation retainer 48 is substantially parallel to the screed plate 24 and forms a space 50 therebetween. The insulating plate 48 performs two functions. Initially, the heated gas passing through the orifices 44, 46 will remain close to the screed plate 24 instead of rising away from the screed plate. The width 55 of the space 50 (see FIG. 5) is selected to ensure that the heated gas will pass through the entire space 50.

The second function of the insulation plate or retainer 48 is to retain an insulating material 54 in position. The insulating material is placed in the parts of the screed removed from the space 50. The insulating material 54 has to withstand the temperatures of the heated gas 52 and 53 which passes through the tunnel 36.

The insulating material prevents heat loss not only from the tunnel 36, but also from the insulating plate 48. The overall purpose of the insulating material 54 and the insulating plate 48 is to maximize the heat transfer from the burner unit 28 directly to the screed plate 24.

Since the insulating plate 48 is insulated on one side by an insulating material 54, the insulating plate 48 maintains most of the heat applied to it. Whatever heat is contained in the insulating plate will be passed through the entire plate by conduction. If the temperature of the insulating plate exceeds the temperature of the screed plate, much of the heat contained within the insulating plate 48 will be radiated to the screed plate, further adding to even heating of the screed plate.

As illustrated in FIG. 2, the insulating plate 48 is formed from two insulating plate portions 56, 58 which intersect at approximately ninety degrees. There are recesses 60, 62 in the insulating plate portions 56, 58 permitting the tunnel branches 40, 42 to extend through the insulating plate 48.

The screed plate 24 is formed from two screed plate portions 64, 66 which intersect at approximately ninety degrees. The space 50 includes the areas between the insulating plate portion 56 and the screed plate portion 64, as well as between the insulating plate portion 58 and the screed plate portion 66.

The screed plate 24 is removably affixed to the screed housing 22 by a plurality of fasteners 68, 70. The fasteners 68, 70 are mounted on flange portions 72, 74 which are formed on the screed plate portions 64, 66, respectively.

When the screed plate 24 is attached to the screed housing 22, there will be a slight space between these two members to permit the heated gas which is passing through the tunnel branches 40, 42 to escape from the space 50, and permit a constant flow of heated air throughout the space 50. Alternately, apertures 76 may be formed in the screed housing 22 to allow this flow of heated gas.

A divider plate 78 is inserted in the tunnel 36 opposite the burner unit 28. The divider plate 78 divides the heated gas flow from the burner unit into the two tunnel branches 40, 42 while minimizing the turbulence in each of the two branches.

Even though the instant description is directed to heating a screed plate, it is to be understood that applying this system to heat any planar surface is within the intended scope of this invention.

Having described the invention, what is claimed is:

1. A heating apparatus to heat a screed for a paving machine comprising:

a screed plate having a substantially planar surface;

a second plate being spaced from the screed plate defining a space therebetween;

a heated gas inlet; and a tunnel communicating the heated gas inlet to the space, at least some heated gas being directed from the tunnel substantially parallel to the surface.

2. The apparatus as described in claim 1, wherein the heated gas is air.

3. The apparatus as described in claim 1, wherein the plate is a portion of the tunnel.

4. The apparatus as described in claim 1, wherein the tunnel comprises a plurality of tunnel branches.

5. The apparatus as described in claim 4, further comprising:

a divider plate inserted in the tunnel opposite the heated gas inlet.

6. The apparatus as described in claim 1, further comprising an orifice connected to an end of the tunnel.

7. The apparatus as described in claim 6, wherein the orifice extends substantially parallel to the surface.

8. The apparatus as described in claim 6, wherein the tunnel comprises a plurality of orifices, at least one of the orifices extending perpendicular to the surface towards the surface.

9. The apparatus as described in claim 1 wherein some heat contained within the plate will be radiated to the surface.

10. A heating apparatus to heat a screed for a paving machine comprising:

a screed plate having a substantially planar surface;

an inlet means for supplying heated gas;

a second plate being spaced from the screed late defining a space therebetween; and a tunnel means for directing at least a portion of the heat gas substantially parallel to the surface within the space.

11. A heating apparatus for heating a screed for a paving machine comprising:

a screed plate having a substantially planar surface;

a heated gas inlet;

an insulator retainer, being spaced from the screed plate defining a space therebetween;

a tunnel means for directing at least a portion of the heated gas substantially parallel to the surface within the space; and insulator means, being inserted on the side of the insulator retainer opposite the space, resisting heat transfer from the insulator retainer and the tunnel means.

12. A method of heating a screed for a paving machine comprising the steps of:

providing a screed plate having a substantially planar surface;

spacing an insulating means a distance from the planar surface;

creating a space between the insulating means and the planar surface;

supplying a heated gas to a location distant from the space, in a non coplanar direction relative to the planar surface; and directing the heated gas from the heated gas supply to the space in a direction substantially parallel to the planar surface.

* * * * *